US007932218B2

(12) United States Patent
Chasan et al.

(10) Patent No.: US 7,932,218 B2
(45) Date of Patent: Apr. 26, 2011

(54) LUBRICANT COMPOSITION

(75) Inventors: David E. Chasan, Teaneck, NJ (US); Patricia R. Wilson, White Plains, NY (US); Marc Ribeaud, Delémont (CH)

(73) Assignee: Ciba Corporation, Tarrytown, NY (US)

( * ) Notice: Subject to any disclaimer, the term of this patent is extended or adjusted under 35 U.S.C. 154(b) by 484 days.

(21) Appl. No.: 11/881,718

(22) Filed: Jul. 27, 2007

(65) Prior Publication Data

US 2008/0051306 A1 Feb. 28, 2008

Related U.S. Application Data

(60) Provisional application No. 60/834,383, filed on Jul. 31, 2006.

(51) Int. Cl.
*C10M 133/40* (2006.01)
*C09K 15/16* (2006.01)

(52) U.S. Cl. ..... 508/262; 508/263; 252/401; 252/405

(58) Field of Classification Search ..... 508/262, 508/263

See application file for complete search history.

(56) References Cited

U.S. PATENT DOCUMENTS

| | | | | |
|---|---|---|---|---|
| 4,069,199 | A | 1/1978 | Ramey et al. | 260/45.75 |
| 4,377,690 | A * | 3/1983 | Moser | 546/19 |
| 5,073,278 | A | 12/1991 | Schumacher et al. | 252/47.5 |
| 5,198,130 | A | 3/1993 | Schumacher | 252/32.7 |
| 5,268,113 | A | 12/1993 | Evans | 252/47.005 |
| 5,273,669 | A | 12/1993 | Schumacher et al. | 252/47.5 |
| 5,714,612 | A * | 2/1998 | Kimura et al. | 546/190 |
| 6,046,261 | A * | 4/2000 | Okamoto et al. | 524/102 |
| 6,699,298 | B2 * | 3/2004 | Wood et al. | 44/275 |
| 6,761,974 | B1 | 7/2004 | Liu et al. | 428/421 |
| 6,875,870 | B2 * | 4/2005 | Wood et al. | 546/244 |
| 7,326,361 | B2 | 2/2008 | Walters et al. | 252/182.13 |
| 2004/0176261 | A1 | 9/2004 | Tojou et al. | 508/485 |

FOREIGN PATENT DOCUMENTS

| | | |
|---|---|---|
| AU | 621910 | 3/1992 |
| WO | 02/04578 | 1/2002 |
| WO | 03/092732 | 11/2003 |

OTHER PUBLICATIONS

Patent Abstracts of Japan Publication No. 60028496, Feb. 13, 1985.
V. Dobrescu et al., Eur. Polym. J., vol. 24, No. 3 pp. 289-294, (1988).
Ke-Liang Zhang et. al., "Study on Light Stabilizer for Hydrotreated Lubricating Oils", University Chemical Engineering Journal, Apr. 2006, pp. 310-314, (Abstract in Chinese and English published by Chinese Electronic Periodical Services, Reference No. 330240).

* cited by examiner

*Primary Examiner* — Ellen M McAvoy
(74) *Attorney, Agent, or Firm* — Howard & Howard Attorneys PLLC

(57) ABSTRACT

Certain NH sterically hindered amine compounds of the formula

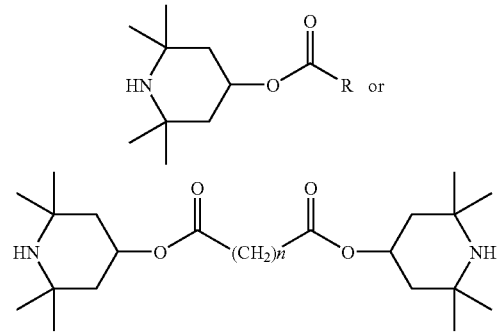

where R is a straight or branched alkyl group of from 7 to 17 carbon atoms and where n is from 6 to 18 are suitable for use as stabilizers in lubricant compositions. The sterically hindered amines are non-aggressive towards fluoroelastomer O-rings or seals.

22 Claims, No Drawings

LUBRICANT COMPOSITION

This application claims benefit of U.S. provisional app. No. 60/834,383, filed Jul. 31, 2006, the contents of which are incorporated by reference.

The present invention relates to lubricant compositions stabilized against oxidative degradation via the incorporation of certain sterically hindered amine stabilizers. The lubricant compositions exhibit excellent results regarding seal swell.

BACKGROUND

U.S. Pat. Nos. 5,073,278 and 5,273,669 teach the stabilization of lubricant compositions with a certain aromatic amine and at least one sterically hindered amine.

U.S. Pat. No. 5,268,113 discloses lubricants stabilized by the addition of a sterically hindered amine and a phenol.

It is known and customary to add stabilizers to lubricants based on mineral or synthetic oils in order to improve their performance characteristics. Antioxidants are of particular importance. Oxidative degradation of lubricants plays a significant role especially in motor oils because of the high temperatures prevailing in the combustion chambers of the engines and the presence, in addition to oxygen, of oxides of nitrogen which act as oxidation catalysts.

Hindered amine compounds are effective stabilizers for lubricants. However, they are generally not employed due to detrimental effects such as seal swell.

The present invention described the stabilization of lubricant compositions with a certain class of hindered amine compounds. The present lubricant compositions are non-aggressive towards seals.

SUMMARY

Provided is a stabilized lubricant composition which comprises a mineral or a synthetic base oil or a mixture of a mineral and a synthetic base oil and one or more sterically hindered amine compounds of the formula

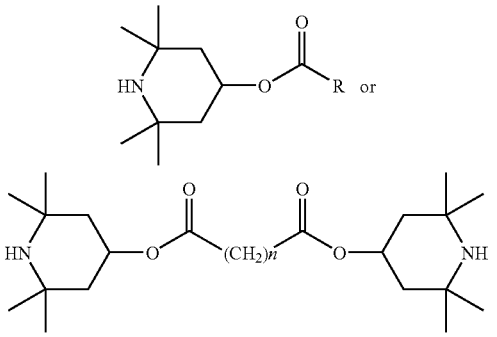

where R is a straight or branched alkyl group of from 7 to 17 carbon atoms and where n is from 6 to 18.

DETAILED DISCLOSURE

The alkyl group R is linear or branched and consist of for example 7, 8, 9, 10, 11, 12, 13, 14, 15, 16 or 17 carbons.

The term n is for example 6, 8, 10, 12, 14, 16 or 18.

The sterically hindered amines are well known and are prepared according to methods known in the art. For example, the present hindered amines are 2,2,6,6-tetramethylpiperidin-4-ol esters of aliphatic carboxylic acids. For example the ester of lauric acid or stearic acid.

In particular, the hindered amine is the compound

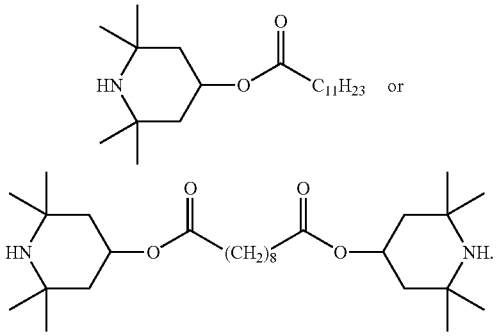

Lubricants according to the present invention are functional fluids, that is lubricants, hydraulic fluids or metal working fluids.

Lubricants are in particular mineral oil based (API classification Group I, Group II or Group III, Group IV including gas to liquid (GTL) oils) or synthetic base oils, such as is normally used for the production of lubricants. Synthetic oils may be, for example, esters of polycarboxylic acids or of polyols; they may also be aliphatic polyesters or poly-α-olefins, silicones, phosphoric acid esters or polalkylene glycols. The lubricant may also be a grease based on an oil and a thickener. Such lubricants are described, for example in D. Klamann "Schmierstoffe und artverwandte Producte", Verlag Chemie, Weinheim, 1982.

Examples are lubricants and hydraulic fluids based on mineral oil or synthetic lubricants or hydraulic fluids, in particular those which are derivatives of carboxylic esters and which are used at temperatures of 200° C. and above.

Examples of synthetic lubricants embrace lubricants based on a diester of a dibasic acid with a monovalent alcohol, for example dioctyl sebacate or dinonyl adipate, a triester of trimethylolpropane with a monobasic acid or a mixture of such acids, for example trimethylolpropane tripelargonate, trimethylolpropane tricaprylate or mixtures of these, a tetraester of pentaerythritol with a monobasic acid or with a mixture of such acids, for example pentaerythritol tetracaprylate, or a complex ester of monobasic and dibasic acids with polyhydric alcohols, for example a complex ester of trimethylolpropane with caprylic and sebacic acid or a mixture of these.

Particularly suitable are, besides mineral oils, for example poly-α-olefins, lubricants based on esters, or phosphates, glycols, polyglycols and polalkyene glycols and mixtures of these with water.

The sterically hindered amines of this invention are in particular non-aggressive toward elastomeric seals.

The seals are in particular a fluoropolymer elastomer used in O-rings and other goods. The "fluoroelastomers" are categorized under ASTM D1418 and ISO 1629 designation of FKM for example. The fluoroelastomers comprise copolymers of hexafluoropropylene (HFP) and vinylidene fluoride (VDF of VF2), terpolymers of tetrafluoroethylene (TFE), vinylidene fluoride and hexafluoropropylene, perfluoromethylvinylether (PMVE), copolymers of TFE and propylene and copolymers of TFE, PMVE and ethylene. The fluorine content varies for example between about 66 to about 70% by weight.

FKM is fluoro rubber of the polymethylene type having substituent fluoro and perfluoroalkyl or perfluoroalkoxy groups on the polymer chain.

Accordingly, a further subject of the invention is a stabilized lubricant composition which is in contact with a fluoroelastomer and which comprises a mineral or a synthetic base oil or a mixture of a mineral and a synthetic base oil and one or more sterically hindered amine compounds of the formula

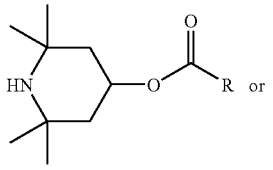

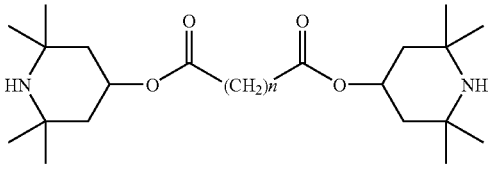

where R is a straight or branched alkyl group of from 7 to 17 carbon atoms and where n is from 6 to 18.

The sterically hindered amines according to this invention are admixed with the lubricants advantageously in an amount of about 0.01 to about 5% by weight, for example from about 0.05 to about 3% by weight, for instance from about 0.1 to about 2% by weight, based on the weight of the lubricant.

The lubricants can additionally comprise other additives which are added to improve the basic properties of lubricants even further; these include antioxidants, metal passivators, rust inhibitors, viscosity index improvers, pour point depressors, dispersants, detergents, high pressure additives, antifriction additives and antiwear additives.

These additional additives are for example:

1. Antioxidants 1.1. Alkylated monophenols, for example 2,6-di-tert-butyl-4-methylphenol, 2-tert-butyl-4,6-dimethylphenol, 2,6-di-tert-butyl-4-ethylphenol, 2,6-di-tert-butyl-4-n-butylphenol, 2,6-di-tert-butyl-4-isobutylphenol, 2,6-dicyclopentyl-4-methylphenol, 2-(α-methylcyclohexyl)-4,6-dimethylphenol, 2,6-dioctadecyl-4-methylphenol, 2,4,6-tricyclohexylphenol, 2,6-di-tert-butyl-4-methoxymethylphenol, 2,6-di-nonyl-4-methylphenol, 2,4-dimethyl-6(1'-methylundec-1'-yl)phenol, 2,4-dimethyl-6-(1'-methylheptadec-1'-yl)phenol, 2,4-dimethyl-6-(1'-methyltridec-1'-yl)phenol and mixtures thereof.

1.2. Alkylthiomethylphenols, for example 2,4-dioctylthiomethyl-6-tert-butylphenol, 2,4-dioctylthiomethyl-6-methylphenol, 2,4-dioctylthiomethyl-6-ethylphenol, 2,6-didodecylthiomethyl-4-nonylphenol.

1.3. Hydroquinones and alkylated hydroquinones, for example 2,6-di-tert-butyl-4-methoxyphenol, 2,5-di-tert-butylhydroquinone, 2,5-di-tert-amylhydroquinone, 2,6-diphenyl-4-octadecyloxyphenol, 2,6-di-tert-butylhydroquinone, 2,5-di-tert-butyl-4-hydroxyanisole, 3,5-di-tert-butyl-4-hydroxyanisole, 3,5-di-tert-butyl-4-hydroxyphenyl stearate, bis-(3,5-di-tert-butyl-4-hydroxyphenyl)adipate.

1.4. Hydroxylated thiodiphenyl ethers, for example 2, 2'-thiobis(6-tert-butyl-4-methylphenol), 2,2'-thiobis(4-octylphenol), 4,4'-thiobis(6-tert-butyl-3-methylphenol), 4,4'-thiobis(6-tert-butyl-2-methylphenol), 4,4'-thiobis-(3,6-di-sec-amylphenol), 4,4'-bis-(2,6-dimethyl-4-hydroxyphenyl) disulfide.

1.5. Alkylidenebisphenols, for example 2, 2'-methylenebis(6-tert-butyl-4-methylphenol), 2,2'-methylenebis(6-tert-butyl-4-ethylphenol), 2,2'-methylenebis[4-methyl-6-α-methylcyclohexyl)phenol], 2,2'-methylenebis(4-methyl-6-cyclohexylphenol), 2,2'-methylenebis(6-nonyl-4-methylphenol), 2,2'-methylenebis(4,6-di-tert-butylphenol), 2,2'-ethylidenebis(4,6-di-tert-butylphenol), 2,2'-ethylidenebis(6-tert-butyl-4-isobutylphenol), 2,2'-methylenebis[6-α-methylbenzyl)-4-nonylphenol], 2,2'-methylenebis[6-(α,α-dimethylbenzyl)-4-nonylphenol], 4,4'-methylenebis(2,6-di-tert-butylphenol), 4,4'-methylenebis(6-tert-butyl-2-methylphenol), 1,1-bis(5-tert-butyl-4-hydroxy-2-methylphenyl)butane, 2,6-bis(3-tert-butyl-5-methyl-2-hydroxybenzyl)-4-methylphenol, 1,1,3-tris(5-tert-butyl-4-hydroxy-2-methylphenyl)butane, 1,1-bis(5-tert-butyl-4-hydroxy-2-methyl-phenyl)-3-n-dodecylmercaptobutane, ethylene glycol bis[3,3-bis(3'-tert-butyl-4'-hydroxyphenyl) butyrate], bis(3-tert-butyl-4-hydroxy-5-methyl-phenyl)dicyclopentadiene, bis[2-(3'-tert-butyl-2'-hydroxy-5'-methylbenzyl)-6-tert-butyl-4-methylphenyl]terephthalate, 1,1-bis-(3,5-dimethyl-2-hydroxyphenyl)butane, 2,2-bis-(3,5-di-tert-butyl-4-hydroxyphenyl)propane, 2,2-bis-(5-tert-butyl-4-hydroxy-2-methylphenyl)-4-n-dodecylmercaptobutane, 1,1,5,5-tetra-(5-tert-butyl-4-hydroxy-2-methylphenyl)pentane.

1.6. O-, N- and S-benzyl compounds, for example 3, 5,3',5'-tetra-tert-butyl-4,4'-dihydroxydibenzyl ether, octadecyl-4-hydroxy-3,5-dimethylbenzylmercaptoacetate, tris-(3,5-di-tert-butyl-4-hydroxybenzyl)amine, bis(4-tert-butyl-3-hydroxy-2,6-dimethylbenzyl)dithioterephthalate, bis(3,5-di-tert-butyl-4-hydroxybenzyl)sulfide, isooctyl-3,5di-tert-butyl-4-hydroxybenzylmercaptoacetate.

1.7. Hydroxybenzylated malonates, for example dioctadecyl-2,2-bis-(3,5-di-tert-butyl-2-hydroxybenzyl)-malonate, di-octadecyl-2-(3-tert-butyl-4-hydroxy-5-methylbenzyl)-malonate, di-dodecylmercaptoethyl-2,2-bis-(3,5-di-tert-butyl-4-hydroxybenzyl)malonate, bis[4-(1,1,3,3-tetramethylbutyl)phenyl]-2,2-bis(3,5-di-tert-butyl-4-hydroxybenzyl) malonate.

1.8. Aromatic hydroxybenzyl compounds, for example 1,3,5-tris-(3,5-di-tert-butyl-4-hydroxybenzyl)-2,4,6-trimethylbenzene, 1,4-bis(3,5-di-tert-butyl-4-hydroxybenzyl)-2,3,5,6-tetramethylbenzene, 2,4,6-tris(3,5-di-tert-butyl-4-hydroxybenzyl)phenol.

1.9. Triazine Compounds, for example 2,4-bis(octylmercapto)-6-(3,5-di-tert-butyl-4-hydroxyanilino)-1,3,5-triazine, 2-octylmercapto-4,6-bis(3,5-di-tert-butyl-4-hydroxyanilino)-1,3,5-triazine, 2-octylmercapto-4,6-bis(3,5-di-tert-butyl-4-hydroxyphenoxy)-1,3,5-triazine, 2,4,6-tris(3,5-di-tert-butyl-4-hydroxyphenoxy)-1,2,3-triazine, 1,3,5-tris(3,5-di-tert-butyl-4-hydroxybenzyl)isocyanurate, 1,3,5-tris(4-tert-butyl-3-hydroxy-2,6-dimethylbenzyl 2,4,6-tris(3,5-di-tert-butyl-4-hydroxyphenylethyl)-1,3,5-triazine, 1,3,5-tris(3,5-di-tert-butyl-4-hydroxyphenylpropionyl)-hexahydro-1,3,5-triazine, 1,3,5-tris(3,5-dicyclohexyl-4-hydroxybenzyl) isocyanurate.

1.10. Benzylphosphonates, for example dimethyl-2,5-di-tert-butyl-4-hydroxybenzylphosphonate, diethyl-3,5-di-tert-butyl-4-hydroxybenzylphosphonate, dioctadecyl-3,5-di-tert-butyl-4-hydroxybenzylphosphonate, dioctadecyl-5-tert-butyl-4-hydroxy-3-methylbenzylphosphonate, the calcium salt of the monoethyl ester of 3,5-di-tert-butyl-4-hydroxybenzylphosphonic acid.

1.11. Acylaminophenols, for example 4-hydroxylauranilide, 4-hydroxystearanilide, octyl N-(3,5-di-tert-butyl-4-hydroxyphenyl)carbamate.

1.12. Esters of [3-(3,5-di-tert-butyl-4-hydroxyphenyl)propionic acid with mono- or polyhydric alcohols, e.g. with methanol, ethanol, octadecanol, 1,6-hexanediol, 1,9-nonanediol, ethylene glycol, 1,2-propanediol, neopentyl glycol, thiodiethylene glycol, diethylene glycol, triethylene glycol, pentaerythritol, tris(hydroxyethyl)isocyanurate, N,N'-bis(hydroxyethyl)oxamide, 3-thiaundecanol, 3-thiapentadecanol, trimethylhexanediol, trimethylolpropane, 4-hydroxymethyl-1-phospha-2,6,7-trioxabicyclo[2.2.2]octane.

1.13. Esters of β-(5-tert-butyl-4-hydroxy-3-methylphenyl) propionic acid with mono- or polyhydric alcohols, e.g. with methanol, ethanol, octadecanol, 1,6-hexanediol, 1,9-nonanediol, ethylene glycol, 1,2-propanediol, neopentyl glycol, thiodiethylene glycol, diethylene glycol, triethylene glycol, pentaerythritol, tris(hydroxyethyl)isocyanurate, N,N'-bis (hydroxyethyl)oxamide, 3-thiaundecanol, 3-thiapentadecanol, trimethylhexanediol, trimethylolpropane, 4-hydroxymethyl-1-phospha-2,6,7-trioxabicyclo [2.2.2]octane.

1.14 Esters of 13-(3,5-dicyclohexyl-4-hydroxyphenyl)propionic acid with mono- or polyhydric alcohols, e.g. with methanol, ethanol, octadecanol, 1,6-hexanediol, 1,9-nonanediol, ethylene glycol, 1,2-propanediol, neopentyl glycol, thiodiethylene glycol, diethylene glycol, triethylene glycol, pentaerythritol, tris(hydroxyethyl)isocyanurate, N,N'-bis(hydroxyethyl)oxamide, 3-thiaundecanol, 3-thiapentadecanol, trimethylhexanediol, trimethylolpropane, 4-hydroxymethyl-1-phospha-2,6,7-trioxabicyclo[2.2.2]octane.

1.15 Esters of 3,5-di-tert-butyl-4-hydroxyphenyl acetic acid with mono- or polyhydric alcohols, e.g. with methanol, ethanol, octadecanol, 1,6-hexanediol, 1,9-nonanediol, ethylene glycol, 1,2-propanediol, neopentyl glycol, thiodiethylene glycol, diethylene glycol, triethylene glycol, pentaerythritol, tris(hydroxyethyl)isocyanurate, N,N'-bis(hydroxyethyl)oxamide, 3-thiaundecanol, 3-thiapentadecanol, trimethylhexanediol, trimethylolpropane, 4-hydroxymethyl-1-phospha-2,6,7-trioxabicyclo[2.2.2]octane.

1.16. Amides of β-(3,5-di-tert-butyl-4-hydroxyphenyl)propionic acid e.g. N,N'-bis(3,5-di-tert-butyl-4-hydroxyphenylpropionyl)hexamethylenediamine, N,N'-bis(3,5-di-tert-butyl-4-hydroxyphenylpropionyl)trimethylenediamine, N,N'-bis(3,5-di-tert-butyl-4-hydroxyphenylpropionyl)hydrazine.

Aminic Antioxidants:

N,N'-diisopropyl-p-phenylenediamine, N,N'-di-sec-butyl-p-phenylenediamine, N,N'-bis(1,4-dimethylpentyl)-p-phenylenediamine, N,N'-bis(1-ethyl-3-methylpentyl)-p-phenylenediamine, N,N'-bis(1-methylheptyl)-p-phenylenediamine, N,N'-dicyclohexyl-p-phenylenediamine, N,N'-diphenyl-p-phenylenediamine, N,N'-bis(2-naphthyl)-p-phenylenediamine, N-isopropyl-N'-phenyl-p-phenylenediamine, N-(1,3-dimethyl-butyl)-N'-phenyl-p-phenylenediamine, N-(1-methylheptyl)-N'-phenyl-p-phenylenediamine, N-cyclohexyl-N'-phenyl-p-phenylenediamine, 4-(p-toluenesulfamoyl)diphenylamine, N,N'-dimethyl-N,N'-di-sec-butyl-p-phenylenediamine, diphenylamine, N-allyldiphenylamine, 4-isopropoxydiphenylamine, N-phenyl-1-naphthylamine, N-phenyl-2-naphthylamine, octylated diphenylamine, for example p,p'-di-tert-octyldiphenylamine, 4-n-butylaminophenol, 4-butyrylaminophenol, 4-nonanoylaminophenol, 4-dodecanoylaminophenol, 4-octadecanoylaminophenol, bis(4-methoxyphenyl)amine, 2,6-di-tert-butyl-4-dimethylaminomethylphenol, 2,4'-diaminodiphenylmethane, 4,4'-diaminodiphenylmethane, N,N, N',N'-tetramethyl-4,4'-diaminodiphenylmethane, 1,2-bis[(2-methyl-phenyl)amino]ethane, 1,2-bis(phenylamino) propane, (o-tolyl)biguamide, bis[4-(1',3'-dimethylbutyl)phenyl]amine, tert-octylated N-phenyl-1-naphthylamine, a mixture of mono- and dialkylated tert-butyl/tert-octyldiphenylamines, a mixture of mono- and dialkylated isopropyl/isohexyldiphenylamines, mixtures of mono- and dialkylated tert-butyldiphenylamines, 2,3-dihydro-3,3-dimethyl-4H-1,4-benzothiazine, phenothiazine, N-allylphenothiazine, N,N,N',N'-tetraphenyl-1,4-diaminobut-2-ene, N,N-bis(2,2,6,6-tetramethylpiperid-4-yl-hexamethylenediamine, bis(2,2,6,6-tetramethylpiperid-4-yl)sebacate, 2,2,6,6-tetramethylpiperidin-4-one and 2,2,6,6-tetramethylpiperidin-4-ol.

Examples of Other Antioxidants:

Aliphatic or aromatic phosphites, esters of thiodipropionic acid or of thiodiacetic acid, or salts of dithiocarbamic or dithiophosphoric acid, 2,2,12,12-tetramethyl-5,9-dihydroxy-3,7,11-trithiamidecane and 2,2,15,15-tetramethyl-5,12-dihydroxy-3,7,10,14-tetrathiahexadecane.

Examples of Metal Deactivators, for Example for Copper, are:

a) Benzotriazoles and derivatives thereof, for example 4- or 5-alkylbenzotriazoles (e.g. tolutriazole) and derivatives thereof, 4,5,6,7-tetrahydrobenzotriazole and 5,5'-methylenebisbenzotriazole; Mannich bases of benzotriazole or tolutriazole, e.g. 1-[bis(2-ethylhexyl)aminomethyl)tolutriazole and 1-[bis(2-ethylhexyl)aminomethyl)benzotriazole; and alkoxyalkylbenzotriazoles such as 1-(nonyloxymethyl)benzotriazole, 1-(1-butoxyethyl)benzotriazole and 1-(1-cyclohexyloxybutyl)tolutriazole.

b) 1,2,4-Triazoles and derivatives thereof, for example 3-alkyl(or aryl)-1,2,4-triazoles, and Mannich bases of 1,2,4-triazoles, such as 1-[bis(2-ethylhexyl)aminomethyl-1,2,4-triazole; alkoxyalkyl-1,2,4-triazoles such as 1-(1-butoxyethyl)-1,2,4-triazole; and acylated 3-amino-1,2,4-triazoles.

c) Imidazole derivatives, for example 4, 4'-methylenebis(2-undecyl-5-methylimidazole) and bis[(N-methyl)imidazol-2-yl]carbinol octyl ether.

d) Sulfur-containing heterocyclic compounds, for example 2-mercaptobenzothiazole, 2,5-dimercapto-1,3,4-thiadiazole and derivatives thereof; and 3,5-bis[di(2-ethylhexyl)aminomethyl]-1,3,4-thiadiazolin-2-one.

e) Amino compounds, for example salicylidenepropylenediamine, salicylaminoguanidine and salts thereof.

Examples of Rust Inhibitors and Friction Modifiers are:

a) Organic acids, their esters, metal salts, amine salts and anhydrides, for example alkyl- and alkenylsuccinic acids and their partial esters with alcohols, diols or hydroxycarboxylic acids, partial amides of alkyl- and alkenylsuccinic acids, 4-nonylphenoxyacetic acid, alkoxy- and alkoxyethoxycarboxylic acids such as dodecyloxyacetic acid, dodecyloxy (ethoxy)acetic acid and the amine salts thereof, and also N-oleoylsarcosine, sorbitan monooleate, lead naphthenate, alkenylsuccinic anhydrides, for example dodecenylsuccinic anhydride, 2-carboxymethyl-1-dodecyl-3-methylglycerol and the amine salts thereof.

b) Nitrogen-containing compounds, for example:

I. Primary, secondary or tertiary aliphatic or cycloaliphatic amines and amine salts of organic and inorganic acids, for example oil-soluble alkylammonium carboxylates, and also 1-[N,N-bis(2-hydroxyethyl)amino]-3-(4-nonylphenoxy) propan-2-ol.

II. Heterocyclic compounds, for example: substituted imidazolines and oxazolines, and 2-heptadecenyl-1-(2-hydroxyethyl)imidazoline.

c) Phosphorus-containing compounds, for example: Amine salts of phosphoric acid partial esters or phosphonic acid partial esters, and zinc dialkyldithiophosphates.

d] Molybdenum-containing compounds, such as Molydbenum dithiocarbamate and other sulphur and phosphorus containing derivatives e) Sulfur-containing compounds, for example: barium dinonylnaphthalenesulfonates, calcium petroleum sulfonates, alkylthio-substituted aliphatic carboxylic acids, esters of aliphatic 2-sulfocarboxylic acids and salts thereof.

f Glycerol derivatives, for example: glycerol monooleate, 1-(alkylphenoxy)-3-(2-hydroxyethyl)glycerols, 1-(alkylphenoxy)-3-(2,3-dihydroxypropyl)glycerols and 2-carboxyalkyl-1,3-dialkylglycerols.

Examples of Viscosity Index Improvers are:

Polyacrylates, polymethacrylates, vinylpyrrolidone/methacrylate copolymers, polyvinylpyrrolidones, polybutenes, olefin copolymers, styrene/acrylate copolymers and polyethers.

Examples of Pour-Point Depressants are:

Polymethacrylate and alkylated naphthalene derivatives.

Examples of Dispersants/Surfactants are:

Polybutenylsuccinic amides or -imides, polybutenylphosphonic acid derivatives and basic magnesium, calcium and barium sulfonates and phenolates.

Examples of Antiwear Additives are:

Sulfur- and/or phosphorus- and/or halogen-containing compounds, e.g. sulfurised olefins and vegetable oils, zinc dialkyldithiophosphates, alkylated triphenyl phosphates, tritolyl phosphate, tricresyl phosphate, chlorinated paraffins, alkyl and aryl di- and trisulfides, amine salts of mono- and dialkyl phosphates, amine salts of methylphosphonic acid, diethanolaminomethyltolyltriazole, bis(2-ethylhexyl)aminomethyltolyltriazole, derivatives of 2,5-dimercapto-1,3,4-thiadiazole, ethyl 3-[(diisopropoxyphosphinothioyl)thio]propionate, triphenyl thiophosphate (triphenylphosphorothioate), tris(alkylphenyl)phosphorothioate and mixtures thereof (for example tris(isononylphenyl)phosphorothioate), diphenyl monononylphenyl phosphorothioate, isobutylphenyl diphenyl phosphorothioate, the dodecylamine salt of 3-hydroxy-1,3-thiaphosphetane 3-oxide, trithiophosphoric acid 5,5,5-tris[isooctyl 2-acetate], derivatives of 2-mercaptobenzothiazole such as 1-[N,N-bis(2-ethylhexyl)aminomethyl]-2-mercapto-1H-1,3-benzothiazole, and ethoxycarbonyl-5-octyldithiocarbamate.

The examples which follow illustrate the invention in greater detail. Parts and percentages are by weight, unless otherwise indicated.

Example

The superiority of the claimed sterically hindered amines over other similar sterically hindered amine additives is illustrated by the following example. A 5W-30 engine oil containing 0.08% P is supplemented with sufficient sterically hindered amine additive to raise the total base number, as measured by ASTM D 4739 by two units. Amine additive A is added at a treat level of 1.0 weight percent and amine additive B is added at a treat level of 1.2%. The oils are stirred at 60° C. for one hour to insure homogeneity. The formulations are tested according to elastomer compatibility procedure CEC-L-39-T-96. The results of the CEC-L-39-T-96 testing of these formulations with an FKM fluorinated rubber are found below. Both amines affected the rubber elastomer.

| | 1 wt % | 2 wt % | 3 wt % | |
|---|---|---|---|---|
| Material | | | | |
| Base formulation | 100 | 99.0 | 98.8 | |
| Amine A | 0 | 1.0 | 0 | |
| Amine B | 0 | 0 | 1.2 | |
| Results | | | | |
| FKM rubber | | | | ACEA Spec |
| Hardness, DIDC, points | −1 | 3 | 0 | −1/+5 |
| Tensile strength, % | −17 | −51 | −33 | −40/+10 |
| Elongation at rupture, % | −29 | −75 | −55 | −5−/+10 |
| Volume variation, % | 0.7 | 1.1 | 1.1 | −1/+5 |

The magnitude of the effect of amine A on tensile strength and elongation at rupture made it totally unsuitable for use relative to specifications such as that of ACEA. Amine B has much less of an effect on the fluorinated rubber—indicating it is suitable for use in engine oils.

Amine A is

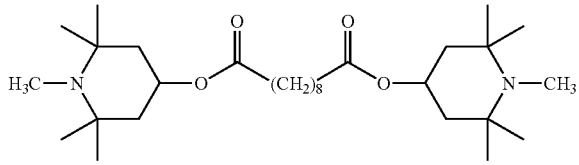

Amine B is

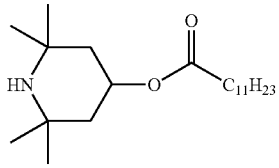

What is claimed is:

1. A stabilized lubricant composition which comprises a mineral or a synthetic base oil or a mixture of a mineral and a synthetic base oil and one or more sterically hindered amine compounds of the formula

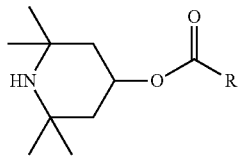

where R is a straight or branched alkyl group of from 7 to 17 carbon atoms.

2. A stabilized lubricant composition according to claim 1 where R is a straight or branched alkyl group of 11 or 17 carbon atoms.

3. A stabilized lubricant composition according to claim 1 where the hindered amine is

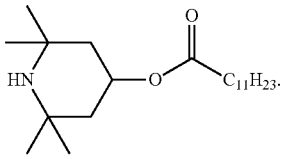

4. A stabilized composition according to claim 1 where the hindered amine is present from about 0.01 to about 5% by weight, based on the weight of the lubricant.

5. A stabilized composition according to claim 1 where the hindered amine is present from about 0.05 to about 3% by weight, based on the weight of the lubricant.

6. A stabilized composition according to claim 1 where the hindered amine is present from about 0.1 to about 2% by weight, based on the weight of the lubricant.

7. A stabilized lubricant composition according to claim 1 where R is a straight or branched alkyl group of 8 to 14 carbon atoms.

8. A stabilized lubricant composition according to claim 1 where R is a straight or branched alkyl group of 10 to 14 carbon atoms.

9. A stabilized lubricant composition according to claim 1 where R is a straight or branched alkyl group of 10 to 12 carbon atoms.

10. A stabilized lubricant composition according to claim 1 where R is a straight or branched alkyl group of 11 to 17 carbon atoms.

11. A stabilized lubricant composition which is in contact with a fluoroelastomer and which comprises a mineral or a synthetic base oil or a mixture of a mineral and a synthetic base oil and one or more sterically hindered amine compounds of the formula

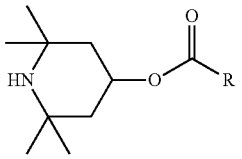

where R is a straight or branched-alkyl group of from 7 to 17 carbon atoms.

12. A stabilized lubricant composition according to claim 11 where R is a straight or branched alkyl group of 11 carbon atoms.

13. A stabilized lubricant composition according to claim 11 where R is a straight or branched alkyl group of 8 to 14 carbon atoms.

14. A stabilized lubricant composition according to claim 11 where R is a straight or branched alkyl group of 10 to 14 carbon atoms.

15. A stabilized lubricant composition according to claim 11 where R is a straight or branched alkyl group of 10 to 12 carbon atoms.

16. A stabilized lubricant composition according to claim 11 where R is a straight or branched alkyl group of 11 to 17 carbon atoms.

17. A stabilized lubricant composition according to claim 11 where R is a straight or branched alkyl group of 11 carbon atoms.

18. A stabilized lubricant composition that passes ACEA E-6 Specifications of hardness points, percent tensile strength, percent elongation at rupture, and percent volume variation when in contact with a fluoroelastomer seal and which comprises a mineral or a synthetic base oil or a mixture of a mineral and a synthetic base oil and one or more sterically hindered amine compounds of the formula

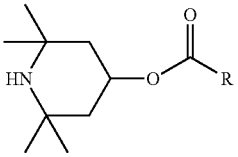

where R is a straight or branched alkyl group of from 7 to 17 carbon atoms.

19. A stabilized lubricant composition according to claim 18 where R is a straight or branched alkyl group of 8 to 14 carbon atoms.

20. A stabilized lubricant composition according to claim 18 where R is a straight or branched alkyl group of 10 to 14 carbon atoms.

21. A stabilized lubricant composition according to claim 18 where R is a straight or branched alkyl group of 10 to 12 carbon atoms.

22. A stabilized lubricant composition according to claim 18 where R is a straight or branched alkyl group of 11 carbon atoms.

* * * * *